US011898251B2

(12) United States Patent
Cadotte et al.

(10) Patent No.: US 11,898,251 B2
(45) **Date of Patent: *Feb. 13, 2024**

(54) SNOUT FOR USE IN A HOT DIP COATING LINE

(71) Applicant: Cleveland-Cliffs Steel Properties Inc., West Chester, OH (US)

(72) Inventors: Daniel J. Cadotte, Middletown, OH (US); Russell Dejarnatt, Liberty Township, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 42 days.

This patent is subject to a terminal disclaimer.

(21) Appl. No.: 17/468,823

(22) Filed: Sep. 8, 2021

(65) Prior Publication Data

US 2021/0404043 A1 Dec. 30, 2021

Related U.S. Application Data

(63) Continuation-in-part of application No. 17/325,403, filed on May 20, 2021.

(60) Provisional application No. 63/028,764, filed on May 22, 2020.

(51) Int. Cl.

| | |
|---|---|
| ***C23C 2/00*** | (2006.01) |
| ***C23C 2/12*** | (2006.01) |
| ***C23C 2/40*** | (2006.01) |

(52) U.S. Cl.

CPC ..... *C23C 2/003* (2013.01); *C23C 2/004* (2022.08); *C23C 2/12* (2013.01); *C23C 2/40* (2013.01)

(58) Field of Classification Search

None

See application file for complete search history.

(56) References Cited

U.S. PATENT DOCUMENTS

| | | | | |
|---|---|---|---|---|
| 3,183,718 | A | 5/1965 | Schnedler | |
| 5,538,559 | A | 7/1996 | Kleinmeyer et al. | |
| 5,718,766 | A * | 2/1998 | Vignot | C23C 2/003 118/423 |
| 6,051,183 | A | 4/2000 | Morando | |
| 6,284,062 | B1 | 9/2001 | Nagashima et al. | |
| 6,428,851 | B1 | 8/2002 | Friedersdorf et al. | |
| 6,770,140 | B2 | 8/2004 | Ishii et al. | |
| 8,047,718 | B2 | 11/2011 | Kim et al. | |

(Continued)

FOREIGN PATENT DOCUMENTS

| | | | |
|---|---|---|---|
| CN | 201172680 | Y | 12/2008 |
| GB | 353410 | A | 7/1931 |

(Continued)

OTHER PUBLICATIONS

International Search Report and Written Opinion for Application No. PCT/US2021/033289, 13 pages.

U.S. Appl. No. 17/325,403, filed May 20, 2021.

*Primary Examiner* — Binu Thomas

(74) *Attorney, Agent, or Firm* — Frost Brown Todd LLP

(57) ABSTRACT

A continuous coating line includes a snout assembly exposed to molten metal. The snout assembly includes a snout tip positioned about a steel strip that is immersible in the molten metal to provide a seal around the steel strip during entry into the molten metal. The snout tip includes a refractory material that is resistant to wear, abrasion, and corrosion when the snout tip is exposed to the molten metal.

16 Claims, 10 Drawing Sheets

(56) References Cited

U.S. PATENT DOCUMENTS

| | | | | |
|---|---|---|---|---|
| 9,133,540 | B2 | 9/2015 | Jang et al. | |
| 2004/0028832 | A1* | 2/2004 | Dauchelle | C23C 2/00 118/400 |
| 2008/0274006 | A1 | 11/2008 | Bright et al. | |
| 2015/0368776 | A1* | 12/2015 | Bergen | C23C 2/06 118/419 |
| 2018/0245192 | A1 | 8/2018 | Kweon et al. | |
| 2019/0062888 | A1* | 2/2019 | Saint-Raymond | C23C 2/003 |
| 2019/0144982 | A1* | 5/2019 | Veg | C23C 2/003 118/400 |
| 2019/0161842 | A1 | 5/2019 | Niedringhaus et al. | |
| 2019/0376171 | A1 | 12/2019 | Cadotte et al. | |
| 2020/0399749 | A1* | 12/2020 | Garcia Martino | C23C 2/003 |
| 2021/0180171 | A1* | 6/2021 | Garcia Martino | C23C 2/003 |

FOREIGN PATENT DOCUMENTS

| | | | |
|---|---|---|---|
| IN | 201817005829 | A | 6/2018 |
| JP | H04-99852 | A | 3/1992 |
| JP | H05-271887 | A | 10/1993 |
| KR | 2018-0023500 | A | 3/2018 |
| WO | WO 2021/084299 | A1 | 5/2021 |

* cited by examiner

SNOUT FOR USE IN A HOT DIP COATING LINE

The present application is a continuation-in-part of U.S. Non-Provisional application Ser. No. 17/325,403, entitled "A Snout For Use In A Hot Dip Coating Line," filed on May 20, 2021, which claims priority to U.S. Provisional Patent Application Ser. No. 63/028,764, entitled "Use of Technical Ceramics To Improve The Life Of Coating Line Snouts," filed on May 22, 2020, the disclosures of which are incorporated by reference herein.

BACKGROUND

Coating is a common process used in steel making to provide a thin metal coating (e.g., aluminum, zinc, etc.) on the surface of a steel substrate, such as an elongated steel sheet or strip. It should be understood that an elongated steel sheet or strip are used and understood herein to be interchangeable. The coating process may be generally incorporated into a continuous coating line where an elongated steel sheet is threaded through a series of roll assemblies to subject the steel sheet to various treatment processes. During the coating portion of this process, the steel sheet is manipulated through a bath of molten metal to coat the surfaces of the steel sheet.

Referring to FIG. 1, an illustrative schematic of a coating portion (10) of a steel processing line (2), such as a continuous steel processing line, is shown. Coating portion (10) is generally configured to receive an elongated steel sheet (60) for coating steel sheet (60). Coating portion (10) includes a hot dip tank (20) that is defined by a solid wall configured to receive molten metal (22), such as aluminum, zinc, and/or alloys thereof. One or more roll assemblies (40, 50, 70) are positioned relative to hot dip tank (20) to support steel sheet (60) through coating portion (10). For instance, sink roll assemblies (40) can be used to position steel sheet (60) in hot dip tank (20). Steel sheet (60) may then be redirected in a desired direction by stab roll assembly (70), through air knives (35), to deflector roll assembly (50).

A snout (30) is positioned about steel sheet (60) at an entry of hot dip tank (20). A bottom portion of snout (30) comprises a snout tip (32) that is configured to be at least partially submerged within molten metal (22). Accordingly, snout (30) generally provides an air-tight seal around steel sheet (60) during entry into molten metal (22). In some instances, snout (30) is filled with a nonreactive or reducing gas such as hydrogen and/or nitrogen to limit chemical oxidation reactions that may occur during entry of steel sheet (60) into molten metal (22).

Accordingly, a snout is generally used in a coating line to protect a steel strip from atmosphere as it feeds into the molten metal. A snout tip is typically immersed in molten metal and is manufactured from ferrous materials (e.g., stainless steel, high carbon steel, etc). Degradation and dissolution of the ferrous material of the snout tip can occur from immersion in the molten metal that can lead to holes and/or breaches in the snout tip. This can expose the steel strip positioned within the snout tip to external atmosphere, which can result in poor coating quality of the steel strip. Degradation of the snout tip can be attributed to dissolution and/or chemical attack of a portion of the snout tip immersed and in contact with the molten metal, and/or erosion of the snout tip by the relative movement of the molten metal at the air-metal interface as well as below the liquid metal surface. Such degradation can require the snout tip to be replaced. For instance, a snout tip in an aluminum coating line is typically replaced about every six months. An example of a prior art degraded snout tip is shown in FIG. 2 after about 8 months in service. When the snout tip is replaced, the continuous coating line is shut down. This procedure generally results in increased costs and undesirable manufacturing delays. However, these costs and delays may be reduced by increasing the service life of snout tips exposed to molten metal.

Accordingly, it may be desirable to include various features within a coating line to improve the overall service life of components subject to wear and/or deterioration. To overcome these challenges, at least a portion of a snout and/or snout tip is made from a refractory material to reduce the amount of wear, abrasion, and/or corrosion on the snout.

SUMMARY

Snout assemblies positioned within coating lines encounter at least some liquid metal abrasion and chemical attack when used within coating baths for coating processes. Under some circumstances, this abrasion and/or chemical attack may lead to reduced duty cycles for such snout assemblies. Thus, it is desirable to reduce abrasion and/or chemical attack encountered with snout assemblies used in coating processes.

Refractory materials, such as ceramic, provide superior resistance to abrasion and chemical attack encountered in environments surrounded by molten metal. Snout assemblies comprising such refractory materials can also be reused in a coating line. Thus, the present application relates to structures and/or methods for incorporating refractory materials into snout assemblies.

BRIEF DESCRIPTION OF THE FIGURES

The accompanying figures, which are incorporated in and constitute a part of this specification, illustrate embodiments, and together with the general description given above, and the detailed description of the embodiments given below, serve to explain the principles of the present disclosure.

DETAILED DESCRIPTION

The present application generally relates to structures and/or methods for incorporating a refractory material within a snout assembly of a continuous coating line. In such a configuration, it has been found that the presence of the refractory material may reduce wear on the snout assembly and may also reduce the propensity of the snout assembly to be subject to chemical attack from the molten metal. This can improve the life of the snout assembly and/or reduce repair costs in a coating line. The life of the snout assembly can thereby be increased, such as by at least 4 times, to avoid line stops and repair cost.

Embodiments of a snout assembly incorporating refractory materials are discussed in more detail below. Because such snout assemblies may reduce wear, corrosion, and/or abrasion of the snout assembly, it should be understood that any element of such a snout assembly may be incorporated into any one or more snout assemblies in a continuous coating line. These snout assemblies may include, but are not limited, to any portion of a snout (30) and/or a snout tip (32) as described above.

I. A SNOUT ASSEMBLIES COMPRISING A REFRACTORY MATERIAL

Figure 1:
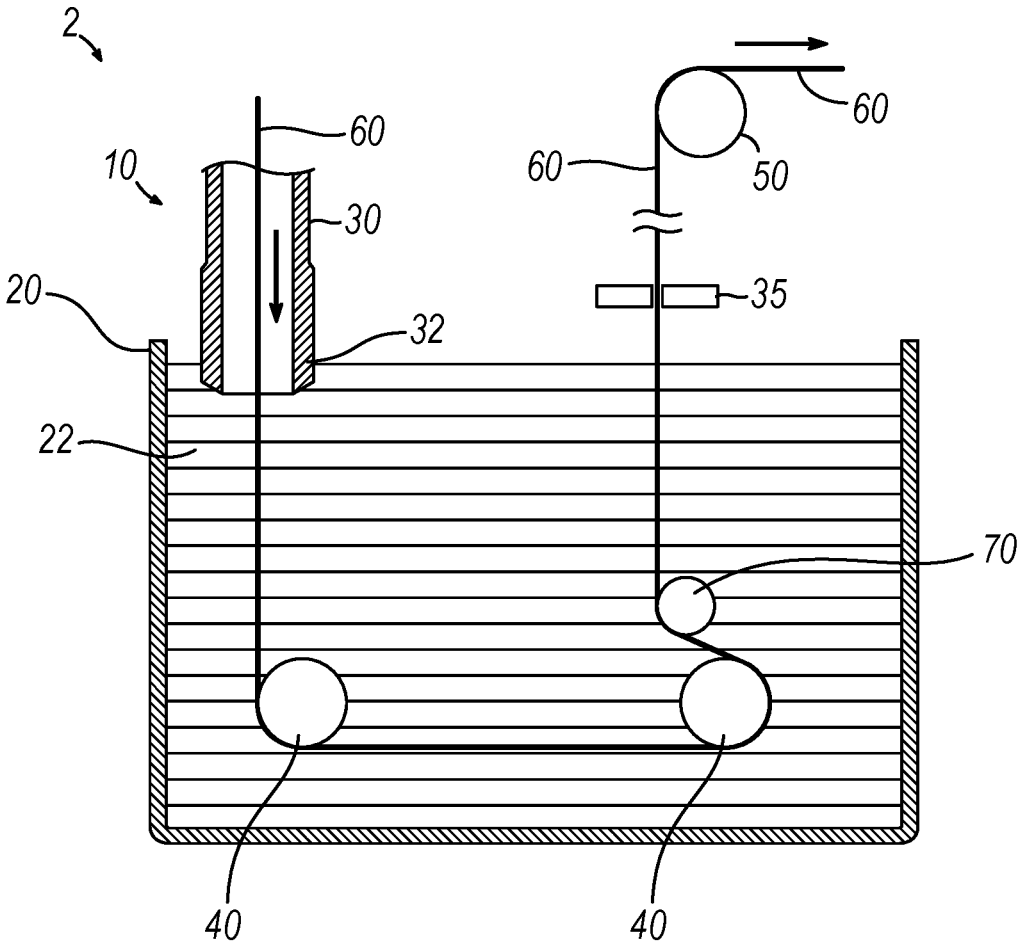
FIG. 1 depicts a schematic view of a configuration of a coating portion in a continuous steel processing line.
Figure 2:
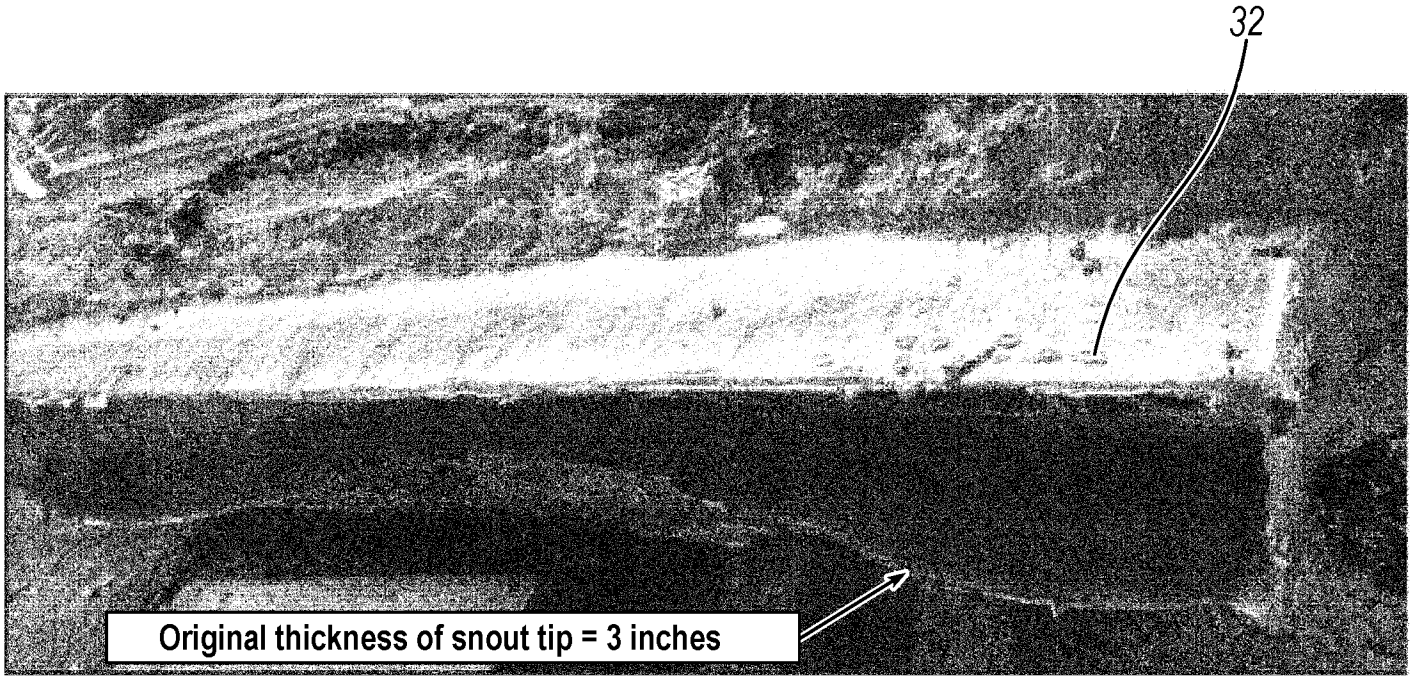
FIG. 2 PRIOR ART
FIG. 2 depicts a photo of a snout tip of a coating portion such as in the continuous steel processing line of FIG. 1 after insertion within a molten aluminum bath.
Figure 3:
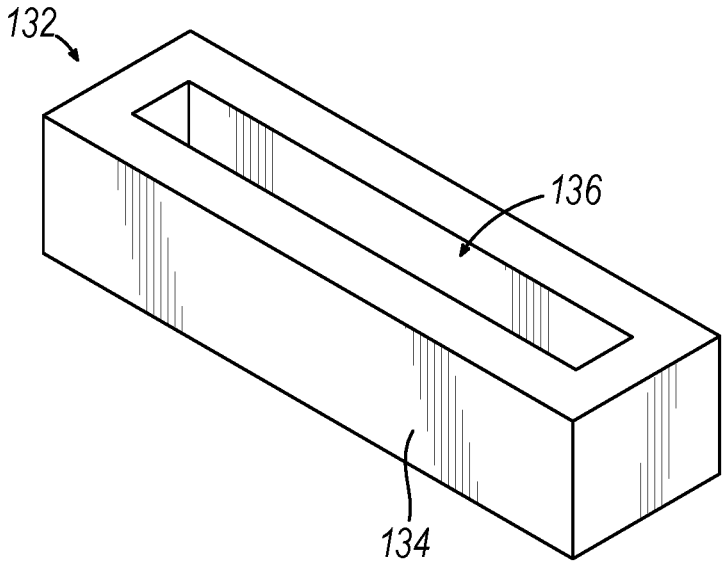
FIG. 3 depicts a perspective view of a first exemplary snout tip having a refractory material for use with a snout in a coating portion such as in the continuous steel processing line of FIG. 1.
Figure 4:
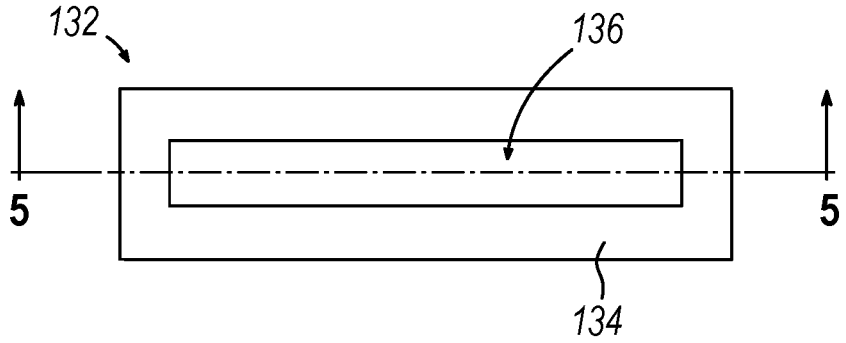
FIG. 4 depicts a top plan view of the snout tip of FIG. 3.
Figure 5:
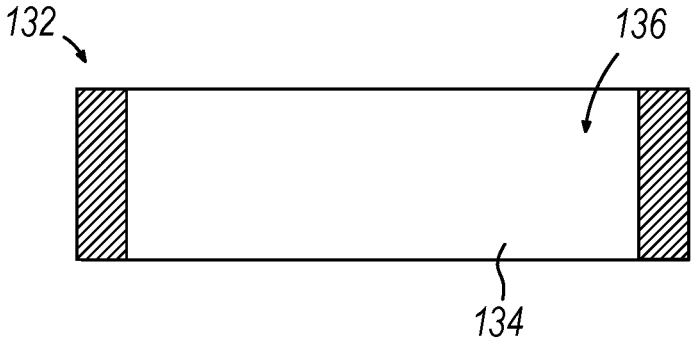
FIG. 5 depicts a cross-sectional view of the snout tip of FIG. 3 taken along line 5-5 of FIG. 4.

Referring to FIGS. 3-5, an exemplary snout tip (132) is shown comprising a body (134) that defines an opening (136) therethrough for receiving steel strip (60). While body (134) and opening (136) are shown as being rectangular in the illustrated version, body (134) and/or opening (136) can be any suitable shape (e.g., square, elliptical, round, etc.) that is configured to receive steel strip (60). For instance, snout tip (132) can be coupled, such as by welding, with a snout (30) of a coating portion (10) in a continuous steel processing line. At least a portion of snout tip (132) is configured to be immersed in molten metal (22) of hot dip tank (20) to thereby protect steel sheet (60) from atmosphere.

Snout tip (132) comprises a refractory material that has high strength and is resistant to wear at high temperature. This refractory material may additionally have a low coefficient of thermal expansion, resistance to thermal shock, resistance to wetting by molten metal, resistance to corrosion, and is substantially chemically inert to molten metals. Such refractory materials can include non-metallic ceramic materials (e.g., alumina, fireclays, bauxite, chromite, dolomite, magnesite, silicon carbide, fused silica, silicon dioxide, zirconia, etc.), refractory metals (e.g., niobium, chromium, molybdenum, tantalum, tungsten, rhenium, vanadium, hafnium, titanium, zirconium, ruthenium, osmium, rhodium, iridium, etc.) and/or combinations thereof. In some versions, the refractory ceramic material comprises between about 5% and about 100% silicon carbide and/or alumina.

By way of example only, suitable refractory ceramic materials may include a class of ceramics known as SiAlON ceramics. SiAlON ceramics are high-temperature refractory materials that may be used in handling molten aluminum. SiAlON ceramics generally exhibit good thermal shock resistance, high strength at high temperatures, exceptional resistance to wetting by molten aluminum, and high corrosion resistance in the presence of molten non-ferrous metals.

Other suitable refractory ceramic materials may include a ceramic having about 73% $Al_2O_3$ and about 8% SiC. This ceramic may comprise GemStone® 404A manufactured by Wahl Refractory Solutions of Fremont, Ohio. In another embodiment, a harder ceramic having a greater amount of SiC, such as about 70% SiC, may be used. In some versions, metal filaments, such as stainless steel wire needles, may be added to the ceramic material, such as about 0.5 percent to about 30 percent by weight of the material. Such a ceramic may comprise ADVANCER® and/or CRYSTON® CN178 nitride bonded silicon carbide manufactured by Saint-Gobain Ceramics of Worcester, Massachusetts, and/or Hexology® silicon carbide also manufactured by Saint-Gobain Ceramics of Worcester, Massachusetts Another suitable refractory ceramic material may include a ceramic having about 59% $Al_2O_3$ and about 33% $SiO_2$. This ceramic may comprise Slurry Infiltrated Fiber Castable (SIFCA®) manufactured by Wahl Refractory Solutions of Fremont, Ohio. Accordingly, snout tip (132) may be made from the same refractory material or from different refractory material. Still other suitable refractory materials will be apparent to one with ordinary skill in the art in view of the teachings herein.

Snout tip (132) can be made by casting the refractory material. In some other versions, components may be made by pouring the liquid refractory material into a mold and using heat to bake the refractory material to remove moisture. An outer surface of the component may then be ground to provide a smooth outer surface. Still other suitable methods to make snout tip (132) will be apparent to one with ordinary skill in the art in view of the teachings herein.

The refractory material of snout tip (132) may provide resistance to wear, thermal shock, and/or corrosion of snout tip (132). Snout tip (132) can also be reusable in coating portion (10) of a steel processing line (2). Snout tip (132) may thereby increase the life of coating portion (10) to increase efficiency and/or reduce costs of the coating line. Accordingly, by forming snout tip (132) from a refractory material, snout tip (132) may better withstand and resist mechanical erosion and cavitation than a steel surface.

In some instances, it can be challenging to join a refractory material of snout tip (132) with a metallic material of snout (30) due to the differences in physical and mechanical properties. Accordingly, in some versions, the refractory material of snout tip (132) can include about 25% by weight addition of metal filaments for additional strength and impact resistance. Such metal filaments can include austenitic stainless steel wire or other suitable metal pieces that can help in attaching snout tip (132) with snout (30), such as by welding.

Figure 6:
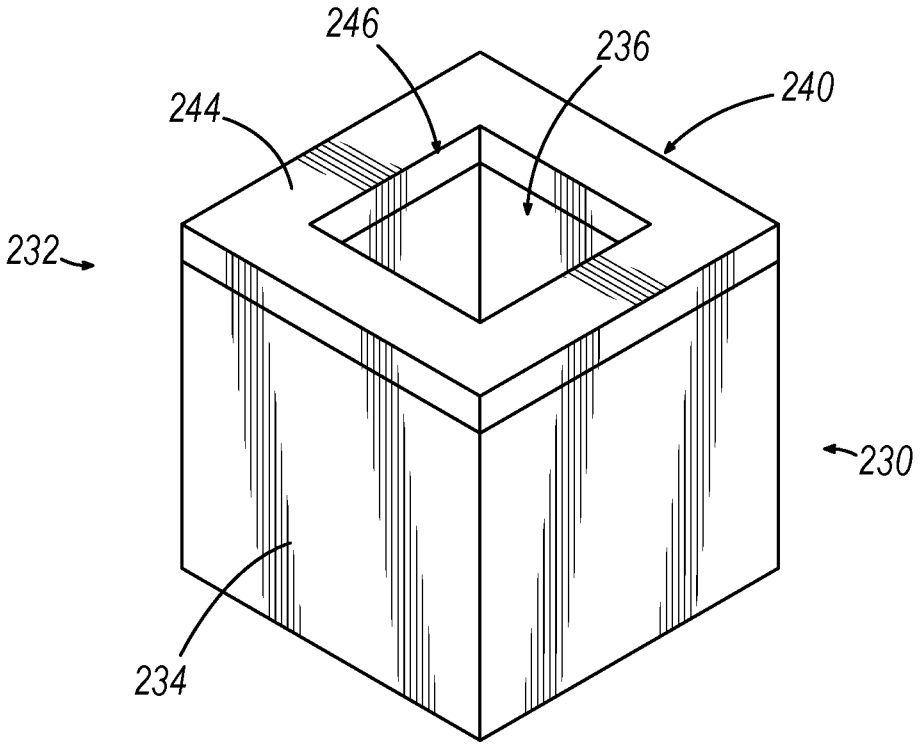
FIG. 6 depicts a perspective view of a second exemplary snout tip having a refractory material for use with a snout in a coating portion such as in the continuous steel processing line of FIG. 1.
Figure 7:
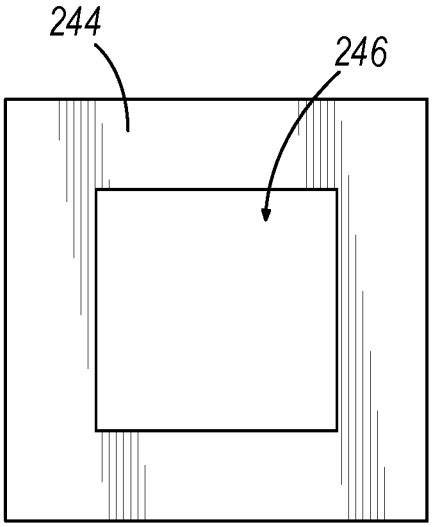
FIG. 7 depicts a top plan view of the snout tip of FIG. 6.
Figure 8:
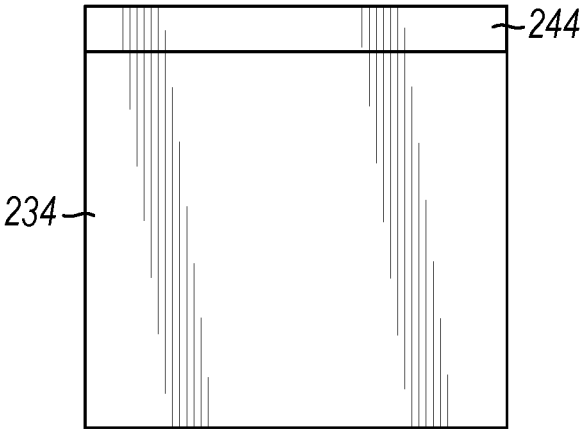
FIG. 8 depicts a front view of the snout tip of FIG. 6.
Figure 9:
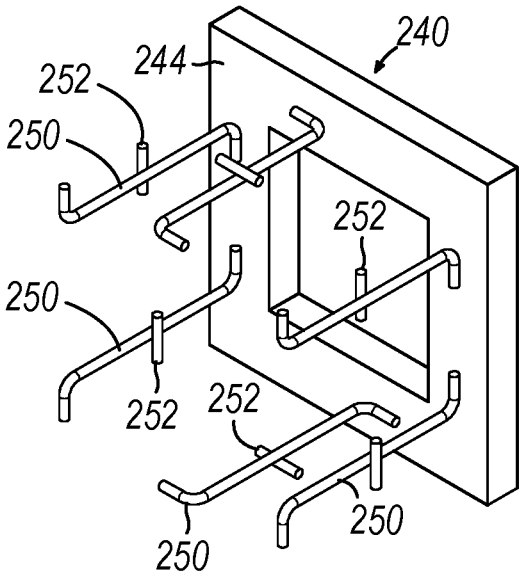
FIG. 9 depicts a perspective view of a plate of the snout tip of FIG. 6.
Figure 10:
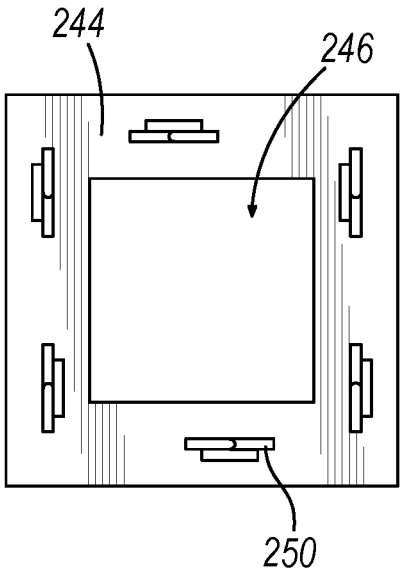
FIG. 10 depicts a bottom view of the plate of FIG. 9.
Figure 11:
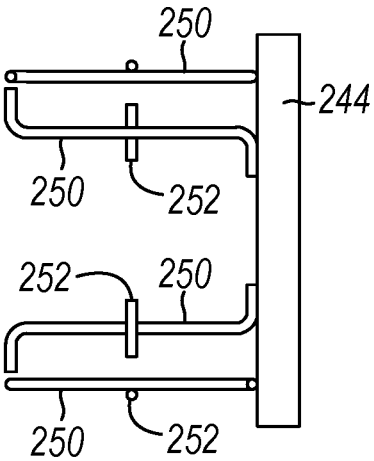
FIG. 11 depicts a side elevational view of the plate of FIG. 9.
Figure 12:
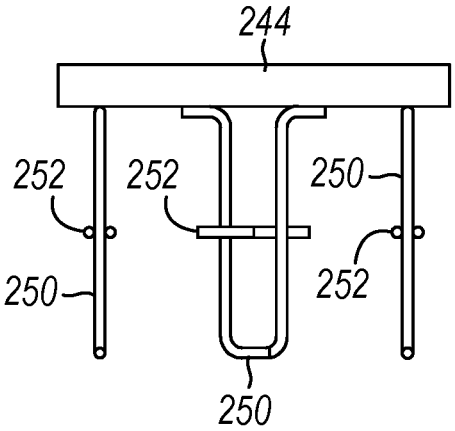
FIG. 12 depicts a front view of the plate of FIG. 9.
Figure 13:
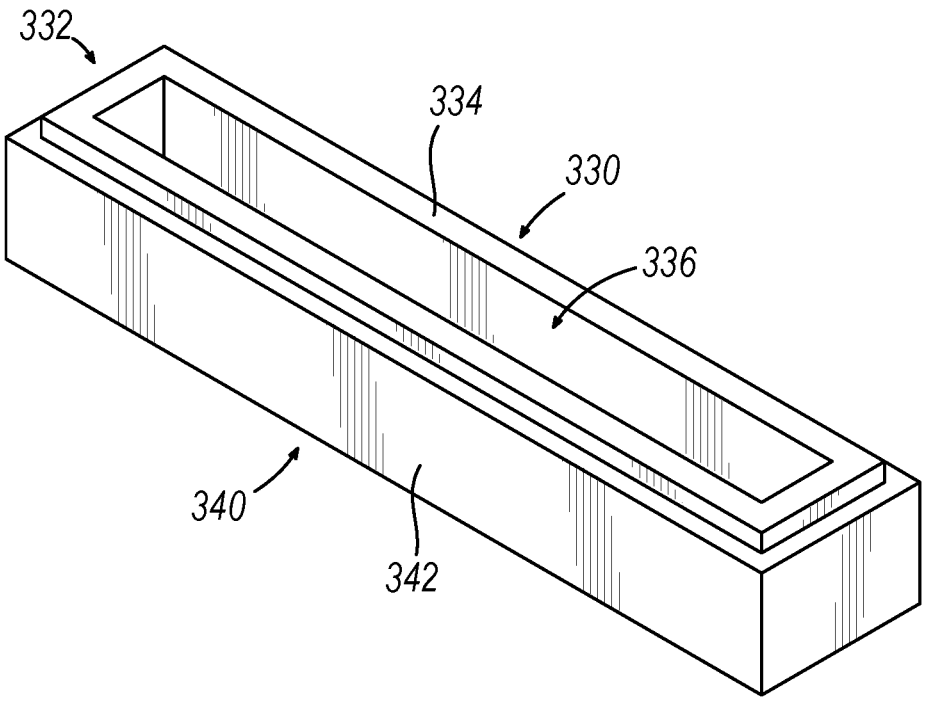
FIG. 13 depicts a perspective view of a third exemplary snout tip having a refractory material for use with a snout in a coating portion such as in the continuous steel processing line of FIG. 1.
Figure 14:
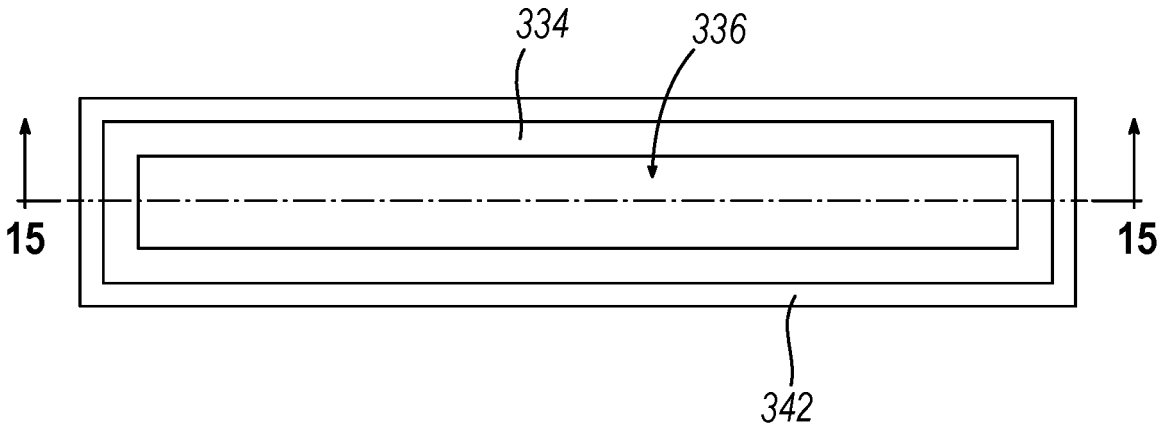
FIG. 14 depicts a top plan view of the snout tip of FIG. 13.
Figure 15:
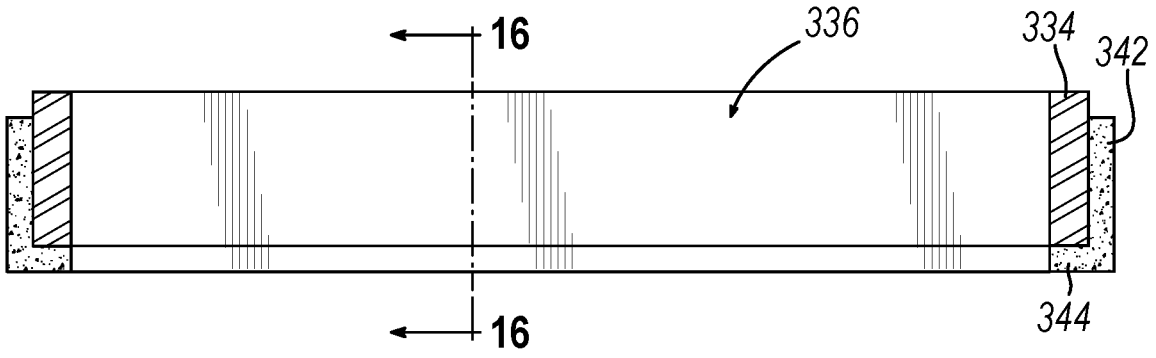
FIG. 15 depicts a cross-sectional view of the snout tip of FIG. 13 taken along line 15-15 of FIG. 14.
Figure 16:
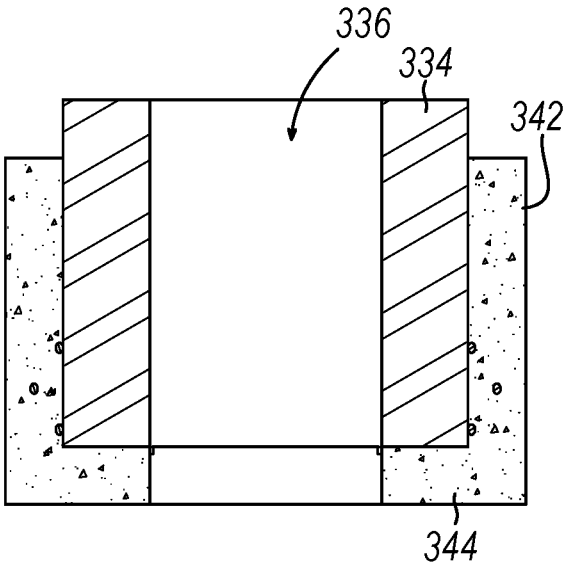
FIG. 16 depicts another cross-sectional view of the snout tip of FIG. 13 taken along line 16-16 of FIG. 15.
Figure 17:
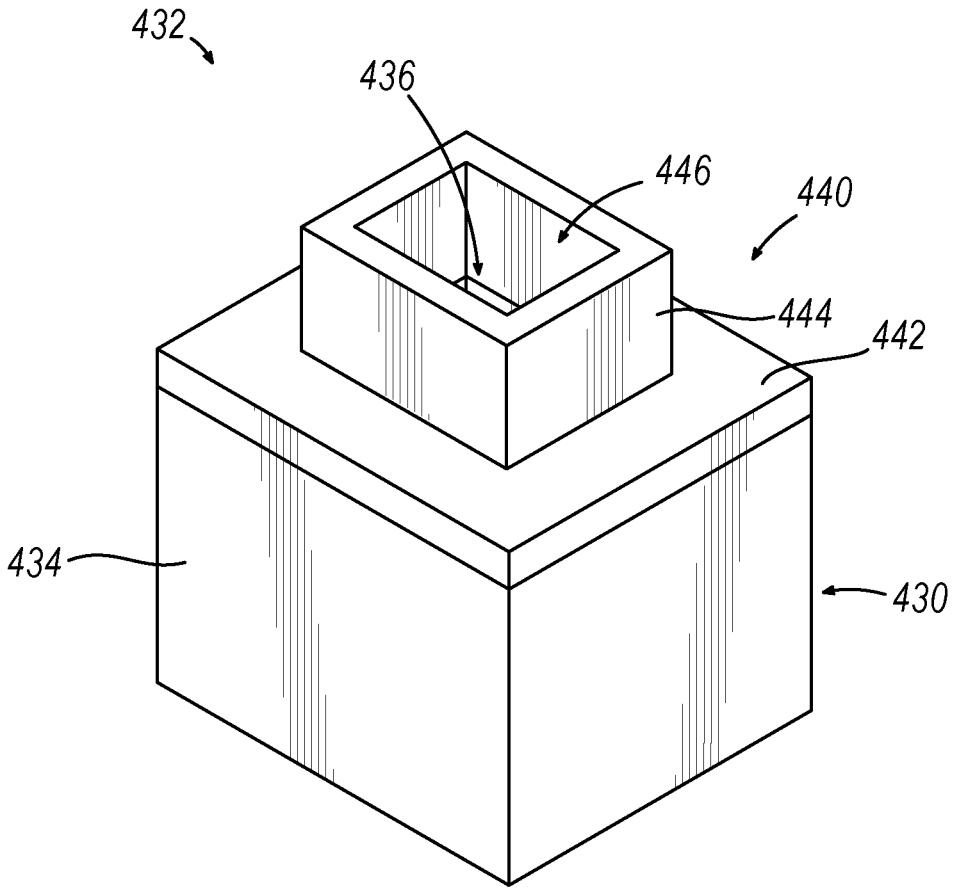
FIG. 17 depicts a perspective view of a fourth exemplary snout tip having a refractory material for use with a snout in a coating portion such as in the continuous steel processing line of FIG. 1.
Figure 18:
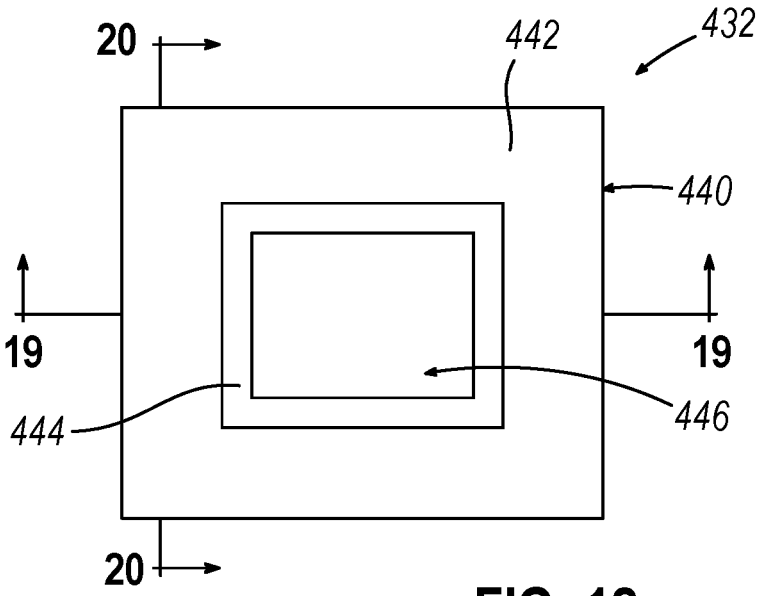
FIG. 18 depicts a top plan view of the snout tip of FIG. 17.

FIGS. 6-8 show another exemplary snout tip (232) that can be coupled with a snout (30) of a coating portion (10) in a continuous steel processing line for receiving steel strip (60). Snout tip (232) comprises a bottom portion (230) coupled with a plate (240). Bottom portion (230) comprises a body (234) that defines an opening (236) therethrough for receiving steel strip (60). While body (234) and opening (236) are shown as being substantially square in the illustrated version, body (234) and/or opening (236) can be any suitable shape (e.g., rectangular, elliptical, round, etc.) that is configured to receive steel strip (60). At least a portion of bottom portion (230) is configured to be immersed in molten metal (22) of hot dip tank (20) to thereby protect steel sheet (60) from atmosphere. Bottom portion (230) can have a thickness of about 12.5 inches and a diameter of about 14 inches to define an opening (236) of about 8 inches by about 8 inches, though other suitable dimensions can be used for providing a portion of snout tip (232) to be submersed in molten metal (22). Bottom portion (230) comprises a refractory material, as described above, that has high strength and is resistant to wear at high temperature.

Bottom portion (230) can be made by casting the refractory material. In some other versions, components may be made by pouring the liquid refractory material into a mold and using heat to bake the refractory material to remove moisture. An outer surface of the component may then be ground to provide a smooth outer surface. Still other suitable methods to make bottom portion (230) will be apparent to one with ordinary skill in the art in view of the teachings herein.

Bottom portion (230) is coupled with plate (240) to improve the connection, such as a weld, between snout tip (232) and snout (30) of coating portion (10) in a continuous steel processing line. Plate (240) is shown in more detail in FIGS. 9-12. Plate (240) of the illustrated version comprises a body (244) that defines an opening (246) therethrough that corresponds to opening (236) of bottom portion (230) for receiving steel strip (60). While body (244) and opening (246) are shown as being substantially square in the illustrated version, body (244) and/or opening (246) can be any suitable shape (e.g., rectangular, elliptical, round, etc.) that is configured to receive steel strip (60). Because it can be difficult to weld a refractory material in some instances, plate (240) can be made of steel, stainless steel, and/or other suitable weldable material that can be welded with a snout (30) to improve a coupling of snout tip (232) with snout (30). Plate (240) can have a thickness of about 1.5 inches and a diameter corresponding to bottom portion (230) of about 14 inches to define an opening (246) of about 8 inches by about 8 inches, though other suitable dimensions can be used to provide a weldable portion for snout tip (232).

In the illustrated version shown in FIGS. 9-12, plate (240) further comprises one or more supports (250) having a first end portion coupled with a bottom surface of body (244) of plate (240) and a second end portion extending downwardly from plate (240) to within body (234) of bottom portion (230). Supports (250) are configured to support and/or maintain the position of bottom portion (230) relative to plate (240). In the illustrated version, each support (250) includes an s-shaped configuration having a crossbar (252) extending transversely relative to support (250) at a central portion of support (250). Such a configuration for supports (250) can be used to couple bottom portion (230) with plate (240), though any other suitable configuration can be used for coupling bottom portion (230) with plate (240). Support (250) can have a length of about 9 inches and a diameter of about ⅜ inches, though any other suitable dimensions can be used for providing support of bottom portion (230). In the illustrated version, plate (240) comprises six supports (250). For instance, a first pair of supports (250) is positioned on a first side portion of plate (240) and a second pair of supports (250) is positioned on an opposing second side portion of plate (240) such that each pair of supports (250) are longitudinally aligned relative to each other. A fifth support (250) is positioned on a third side portion of plate (240) and a sixth support (250) is positioned on an opposing fourth side portion of plate (240) such that these supports (250) are longitudinally offset relative to each other. Still other suitable configurations and/or number of supports (250) can be used for providing support of bottom portion (230). Each support (250) can be made of steel or any other suitable material for supporting bottom portion (230) on plate (240). Accordingly, a refractory material of bottom portion (230) can be cast about supports (250) to form snout tip (232).

The refractory material of bottom portion (230) of snout tip (232) may thereby provide resistance to wear, thermal shock, and/or corrosion of snout tip (232). Snout tip (232) may thereby increase the life of coating portion (10) to increase efficiency and/or reduce costs of the coating line. Accordingly, by forming bottom portion (230) of snout tip (232) from a refractory material, snout tip (232) may better withstand and resist mechanical erosion and cavitation than a steel surface.

FIGS. 13-16 show another exemplary snout tip (332) that can be coupled with a snout (30) of a coating portion (10) in a continuous steel processing line for receiving steel strip (60). Snout tip (332) comprises a core (330) and an outer layer (340). Core (330) comprises a body (334) that defines an opening (336) therethrough for receiving steel strip (60). While body (334) and opening (336) are shown as being substantially rectangular in the illustrated version, body (334) and/or opening (336) can be any suitable shape (e.g., square, elliptical, round, etc.) that is configured to receive steel strip (60). Core (330) can be made from steel and/or any other suitable material. Core (330) can have a width of about 14 inches, a length of about 82 inches, a height of about 12 inches, and a thickness of about 3 inches to form an opening (336) of about 8 inches by about 76 inches, though any other suitable dimensions can be used for receiving steel strip (60).

Outer layer (340) is positioned about at least a portion of an outer surface of body (334) of core (330). For instance, outer layer (340) comprises a side portion (342) extending along an outer surface of a side portion of body (334) and a bottom portion (344) extending along an outer surface of a bottom portion of body (334). Outer layer (340) comprises a refractory material, as described above, that has high strength and is resistant to wear at high temperature. Accordingly, when at least a portion of snout tip (332) is configured to be immersed in molten metal (22) of hot dip tank (20) to protect steel sheet (60) from atmosphere, outer layer (340) is configured to protect core (330) from molten metal (22). Outer layer (340) can have a thickness of about 2 inches, though any other suitable dimensions can be used for sufficient protection of core (330) from molten metal (22).

Outer layer (340) can be made by casting the refractory material about core (330). In some other versions, components may be made by pouring a liquid refractory material into a mold and using heat to bake the refractory material to remove moisture. In some versions, body (334) of core (330) can include one or more recesses extending inwardly within body (334) from an outer surface of body (334) adjacent to outer layer (340) that are configured to receive the refractory material within the one or more recesses to aid in the attachment of outer layer (340) with core (330). An outer surface of the component may then be ground to provide a smooth outer surface. Still other suitable methods to make outer layer (340) will be apparent to one with ordinary skill in the art in view of the teachings herein.

Accordingly, the refractory material of outer layer (340) of snout tip (332) may provide resistance to wear, thermal shock, and/or corrosion of snout tip (332). Snout tip (332) may thereby increase the life of coating portion (10) to increase efficiency and/or reduce costs of the coating line. Accordingly, by forming outer layer (340) of snout tip (332) from a refractory material, snout tip (332) may better withstand and resist mechanical erosion and cavitation than a steel surface.

FIGS. 17-20 show another exemplary snout tip (432) that can be coupled with a snout (30) of a coating portion (10) in a continuous steel processing line for receiving steel strip (60). Snout tip (432) comprises a bottom portion (430) coupled with a support (440). Bottom portion (430) comprises a body (434) that defines an opening (436) therethrough for receiving steel strip (60). While body (434) and opening (436) are shown as being substantially square in the illustrated version, body (434) and/or opening (436) can be any suitable shape (e.g., rectangular, elliptical, round, etc.) that is configured to receive steel strip (60). At least a portion of bottom portion (430) is configured to be immersed in molten metal (22) of hot dip tank (20) to thereby protect steel sheet (60) from atmosphere. Bottom portion (430) comprises a refractory material, as described above, that has high strength and is resistant to wear at high temperature.

Bottom portion (430) can be made by casting the refractory material. In some other versions, components may be made by pouring the liquid refractory material into a mold and using heat to bake the refractory material to remove moisture. An outer surface of the component may then be ground to provide a smooth outer surface. Still other suitable methods to make bottom portion (430) will be apparent to one with ordinary skill in the art in view of the teachings herein.

Bottom portion (430) is coupled with support (440) to improve the connection, such as a weld, between snout tip (432) and snout (30) of coating portion (10) in a continuous steel processing line. Support (440) of the illustrated version comprises a flange (442) and a top plate (444) extending above flange (442) that defines an opening (446) therethrough that corresponds to opening (436) of bottom portion (430) for receiving steel strip (60). While flange (442), top plate (444), and opening (446) are shown as being substantially square in the illustrated version, flange (442), top plate (444), and/or opening (446) can be any suitable shape (e.g., rectangular, elliptical, round, etc.) that is configured to receive steel strip (60). Flange (442) and/or top plate (444) may have a thickness of about % inches, though other suitable dimensions may be used. Because it can be difficult to weld a refractory material in some instances, support (440) can be made of steel, stainless steel, and/or other suitable weldable material that can be welded with a snout (30) to improve a coupling of snout tip (432) with snout (30).

Figure 19:
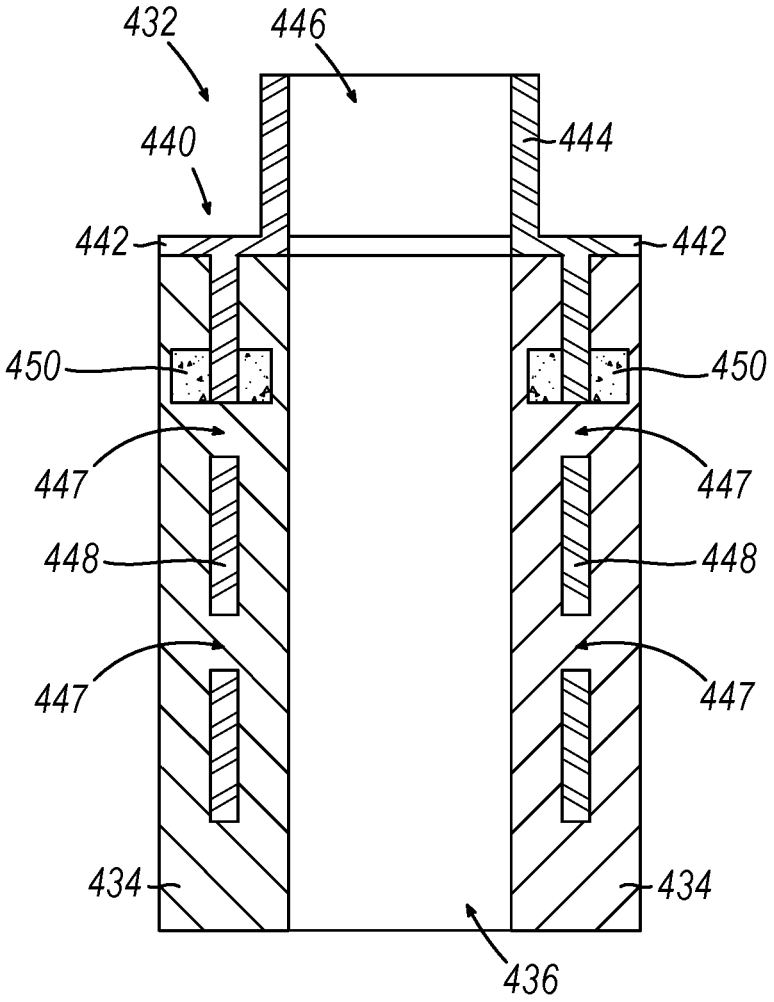
FIG. 19 depicts a cross-sectional view of the snout tip of FIG. 17 taken along line 19-19 of FIG. 18.
Figure 20:
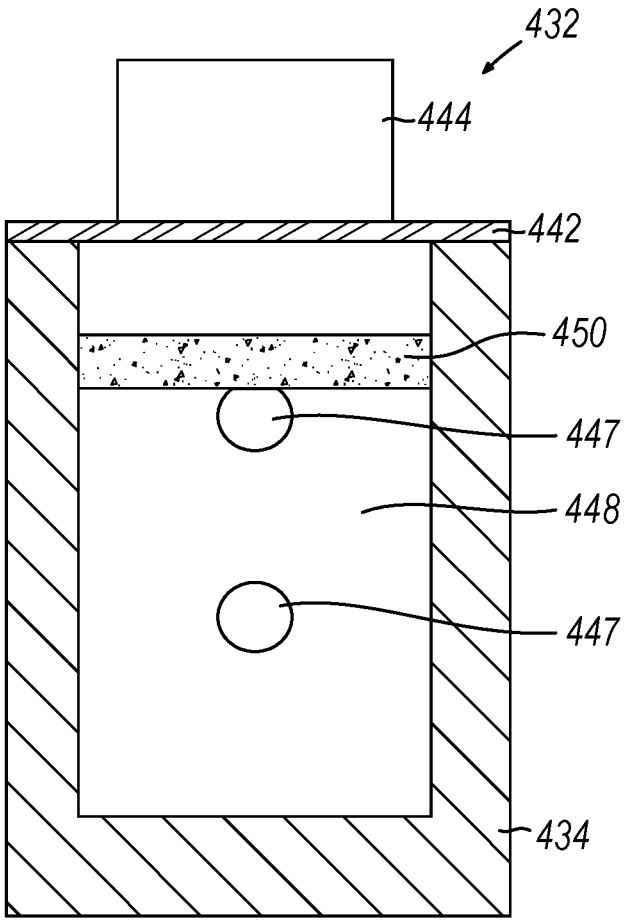
FIG. 20 depicts another cross-sectional view of the snout tip of FIG. 17 taken along line 20-20 of FIG. 18.

As shown best in FIGS. 19-20, support (440) further comprises one or more lower plates (448) on one or more sides of support (440) extending below flange (442) to within body (434) of bottom portion (430). Each lower plate (448) is configured to support and/or maintain the position of bottom portion (430) relative to support (440). In the illustrated version, each lower plate (448) includes one or more openings (447) extending through lower plate (448) for receiving refractory material of bottom portion (430) therethrough, which may provide additional support for bottom portion (430). Such a configuration for lower plate (448) can be used to couple bottom portion (430) with support (440), though any other suitable configuration can be used for coupling bottom portion (430) with support (440).

In some versions, it may be difficult to maintain sufficient contact between the refractory material and the metal material of a snout tip to maintain a sufficient atmospheric pressure within the snout tip for coating a steel strip. Accordingly, in the illustrated version, snout tip (432) further comprises a seal (450) between bottom portion (430) and support (440). In the illustrated version, seal (450) is positioned between body (434) of bottom portion (430) and lower plate (448) of support (440) on an inner surface and/or outer surface of lower plate (448), such as above opening(s) (447) of lower plate (448). Seal (450) may comprise a metal material that has a lower melting point than support (440) such that seal (450) may become liquid at an operating temperature of snout tip (432) to thereby provide a seal between the refractory material of bottom portion (430) and the steel material of support (440). Such a seal may maintain a sufficient atmospheric pressure within snout tip (432), such as about 15 pounds per square inch (psi), though other suitable pressures may be used for coating steel strip (60). Seal (450) may include an aluminum and/or zinc alloy, though other suitable materials may be used for providing a liquid seal. For instance, seal (450) may have a melting point from about 700° F. to about 1300° F., such as about 1000° F., though other suitable temperatures may be used. This may allow seal (450) to become liquid at an operating temperature of snout tip (432), such as about 1250° F. to about 1350° F., though other suitable temperatures may be used. In some versions, a clearance, such as about 0.010 inches, may be provided about the exterior surface of seal (450) to allow for expansion of seal (450), though any other suitable dimensions may be used to allow for expansion of seal (450).

Support (440) can have a length of about 14 inches and a diameter of about 4½ inches, though any other suitable dimensions can be used for providing support of bottom portion (430). Lower plate (448) may have a length of about 11¼ inches to extend within about 80% of bottom portion (430), though other suitable dimensions may be used. Lower plate (448) may have a thickness of about ½ inches and body (434) of bottom portion (430) may extend outwardly about 2 inches from each surface of lower plate (448) such that each wall of bottom portion (430) has a thickness of about 4½ inches, though other suitable dimensions may be used. Accordingly, a refractory material of bottom portion (430) can be cast about lower plate (448) of support (440) to form snout tip (432).

The refractory material of bottom portion (430) of snout tip (432) may thereby provide resistance to wear, thermal shock, chemical attack and/or corrosion of snout tip (432). Snout tip (432) may thereby increase the life of coating portion (10) to increase efficiency and/or reduce costs of the coating line. Accordingly, by forming bottom portion (430) of snout tip (432) from a refractory material, snout tip (432) may better withstand and resist mechanical erosion and cavitation than a steel surface.

II. EXAMPLES

A test was performed to evaluate a snout assembly comprising a refractory material, which is detailed below in the following Examples. It should be understood that the following examples are merely for illustrative purposes and that in other instances, various alternative characteristics may be used as will be understood by those of ordinary skill in the art in view of the teachings herein.

Example 1

A snout assembly having a snout tip similar to snout tip (132) described above was prepared to perform an in situ trial. The snout assembly included a snout tip comprising a ceramic material. In the trial, the snout tip was made from SIFCA A1 having 25% stainless steel wire filaments mixed with the ceramic material. The density of the snout tip was about 0.107 pounds per cubic inch. The snout tip was immersed in molten aluminum for 34 days. The snout tip was heated at a rate of about 100° F. per hour to about 1300° F. The Linear Coefficient of Thermal Expansion (LTCE) was calculated to be about 10.1×10' in/in/° F. The snout tip was then visually inspected, and it was determined that there was not a substantial change in the weight or dimensions of the snout tip. Through the visual inspection, there were cracks in a few areas of localized degradation. The trial was considered to be successful.

Example 2

A snout tip for use in a snout assembly of a continuous coating line, wherein the snout tip comprises: a bottom portion comprising a body defining an opening therethrough for receiving a steel strip, wherein at least a portion of the body is configured to be immersed in molten metal, wherein the body comprises a refractory material; and a support coupled with the bottom portion for supporting the bottom portion relative to the snout assembly, wherein a portion of the support extends within the body of the bottom portion.

Example 3

The snout tip of example 2, wherein the refractory material comprises a select one or more of alumina, silicon dioxide, silicon carbide, and fused silica.

Example 4

The snout tip of any one or more of examples 2 through 3, wherein the support is weldable with a snout of the snout assembly.

Example 5

The snout tip of any one or more of examples 2 through 4, wherein the support comprises a flange positioned above the body of the bottom portion and one or more plates extending from the flange to within the body of the bottom portion to provide support of the bottom portion relative to the flange.

Example 6

The snout tip of example 5, wherein each plate of the one or more plates include an opening extending therethrough, wherein the opening is configured to receive the refractory material of the bottom portion.

Example 7

The snout tip of any one or more of examples 2 through 6, wherein the support comprises a second plate extending above the flange, wherein the second plate is coupled with a snout of the snout assembly.

Example 8

The snout tip of any one or more of examples 2 through 7, further comprising a seal positioned between the support and the bottom portion configured to maintain a pressure within the snout tip.

Example 9

The snout tip of example 8, wherein the seal comprises a metal alloy having a melting temperature below an operating temperature of the snout assembly such that the seal is in a liquid phase during operation of the snout assembly.

Example 10

A snout tip for use in a snout assembly of a continuous coating line, wherein the snout tip comprises: a bottom portion comprising a body defining an opening therethrough for receiving a steel strip, wherein at least a portion of the body is configured to be immersed in molten metal, wherein the body comprises a refractory material; a support coupled with the bottom portion for supporting the bottom portion relative to the snout assembly, wherein a portion of the support extends within the body of the bottom portion; and a seal positioned between the support and the bottom portion configured to maintain a pressure within the snout tip.

Example 11

The snout tip of example 10, wherein the seal comprises a metal alloy having a melting temperature below an operating temperature of the snout assembly such that the seal is in a liquid phase during operation of the snout assembly.

Example 12

The snout tip of any one or more of examples 10 through 11, wherein the support comprises a flange positioned above the body of the bottom portion and one or more plates extending from the flange to within the body of the bottom portion to provide support of the bottom portion relative to the flange.

Example 13

The snout tip of example 12, wherein the seal is positioned on an interior surface and an exterior surface of each plate of the one or more plates.

Example 14

The snout tip of any one or more of examples 12 through 13, wherein each plate of the one or more plates include an opening extending therethrough, wherein the opening is configured to receive the refractory material of the bottom portion.

Example 15

The snout tip of example 14, wherein the seal is positioned above the opening.

Example 16

The snout tip of any one or more of examples 10 through 15, wherein the support comprises a second plate extending above the flange, wherein the second plate is coupled with a snout of the snout assembly.

Example 17

A coating portion of a continuous coating line configured to receive an elongated steel sheet for coating the steel sheet comprising: a hot dip tank for receiving molten metal; one or more roll assemblies for supporting the steel sheet through the coating portion; and a snout assembly positioned about the steel sheet at an entry of the hot dip tank, wherein the snout assembly comprises: a bottom portion comprising a body defining an opening therethrough for receiving a steel strip, wherein at least a portion of the body is configured to be immersed in molten metal, wherein the body comprises a refractory material; a support coupled with the bottom portion for supporting the bottom portion relative to the snout assembly, wherein a portion of the support extends within the body of the bottom portion; and a seal positioned between the support and the bottom portion configured to maintain a pressure within the snout tip.

What is claimed is:

1. A snout tip for use in a snout assembly of a continuous coating line, wherein the snout tip comprises:

a bottom portion comprising a body defining an opening therethrough for receiving a steel strip, wherein at least a portion of the body is configured to be immersed in molten metal, wherein the body comprises a refractory material; and a support coupled with the bottom portion for supporting the bottom portion relative to the snout assembly, wherein a portion of the support extends within the body of the bottom portion, and wherein the support comprises a flange positioned above the body of the bottom portion.

2. The snout tip of claim 1, wherein the refractory material comprises a select one or more of alumina, silicon dioxide, silicon carbide, and fused silica.

3. The snout tip of claim 1, wherein the support is weldable with a snout of the snout assembly.

4. The snout tip of claim 1, wherein one or more plates extending from the flange to within the body of the bottom portion to provide support of the bottom portion relative to the flange.

5. The snout tip of claim 4, wherein each plate of the one or more plates include an opening extending therethrough, wherein the opening is configured to receive the refractory material of the bottom portion.

6. The snout tip of claim 4, wherein the support comprises a second plate extending above the flange, wherein the second plate is coupled with a snout of the snout assembly.

7. The snout tip of claim 1 further comprising a seal positioned between the support and the bottom portion configured to maintain a pressure within the snout tip.

8. The snout tip of claim 7, wherein the seal comprises a metal alloy having a melting temperature below an operating temperature of the snout assembly such that the seal is in a liquid phase during operation of the snout assembly.

9. A snout tip for use in a snout assembly of a continuous coating line, wherein the snout tip comprises:

a bottom portion comprising a body defining an opening therethrough for receiving a steel strip, wherein at least a portion of the body is configured to be immersed in molten metal, wherein the body comprises a refractory material;

a support coupled with the bottom portion for supporting the bottom portion relative to the snout assembly, wherein a portion of the support extends within the body of the bottom portion; and a seal positioned between the support and the bottom portion configured to maintain a pressure within the snout tip.

10. The snout tip of claim 9, wherein the seal comprises a metal alloy having a melting temperature below an operating temperature of the snout assembly such that the seal is in a liquid phase during operation of the snout assembly.

11. The snout tip of claim 9, wherein the support comprises a flange positioned above the body of the bottom portion and one or more plates extending from the flange to within the body of the bottom portion to provide support of the bottom portion relative to the flange.

12. The snout tip of claim 11, wherein the seal is positioned on an interior surface and an exterior surface of each plate of the one or more plates.

13. The snout tip of claim 11, wherein each plate of the one or more plates include an opening extending therethrough, wherein the opening is configured to receive the refractory material of the bottom portion.

14. The snout tip of claim 13, wherein the seal is positioned above the opening.

15. The snout tip of claim 11, wherein the support comprises a second plate extending above the flange, wherein the second plate is coupled with a snout of the snout assembly.

16. A coating portion of a continuous coating line configured to receive an elongated steel sheet for coating the steel sheet comprising:

a hot dip tank for receiving molten metal;

one or more roll assemblies for supporting the steel sheet through the coating portion; and a snout assembly positioned about the steel sheet at an entry of the hot dip tank, wherein the snout assembly comprises:

a bottom portion comprising a body defining an opening therethrough for receiving a steel strip, wherein at least a portion of the body is configured to be immersed in molten metal, wherein the body comprises a refractory material;

a support coupled with the bottom portion for supporting the bottom portion relative to the snout assembly, wherein a portion of the support extends within the body of the bottom portion; and a seal positioned between the support and the bottom portion configured to maintain a pressure within the snout tip.

* * * * *